US005816791A

United States Patent [19]

Home

[11] Patent Number: 5,816,791

[45] Date of Patent: Oct. 6, 1998

[54] APPARATUS FOR CONTROLLING GAS SUPPLY

[76] Inventor: William Home, 9th Fl/3, No. 374, Sec. 2, Pa-Teh Rd., Taipei, Taiwan

[21] Appl. No.: 859,090

[22] Filed: May 20, 1997

[51] Int. Cl.[6] ..... F23Q 9/08

[52] U.S. Cl. ..... 431/46

[58] Field of Search ..... 431/45, 46

[56] References Cited

U.S. PATENT DOCUMENTS 4,111,639 9/1978 Matthews ..... 431/46

5,018,964 5/1991 Shah ..... 431/45

*Primary Examiner*—Carroll B. Dority

*Attorney, Agent, or Firm*—A & J

[57] ABSTRACT

An apparatus for controlling gas supply includes a battery supply, a pilot seat on which are mounted a thermopile, a pilot burner, a spark generator and a detector, a pilot valve, a main burner valve, an auxiliary burner valve, and a control board including a pilot timer control for controlling electric power to the control board from the battery supply, a pilot control circuit controlled by the pilot timer control for controlling electric current supplied to the pilot valve, a main valve control circuit for controlling the main burner valve, an ignitor control circuit connected to the main valve control circuit for controlling the spark generator, a pilot and main valve transfer control connected to the battery supply for switching the battery supply to the thermopile, an auxiliary valve transfer control for controlling the auxiliary burner valve, an auxiliary valve control circuit for controlling the auxiliary valve transfer control, an auxiliary timer connected to the battery supply for controlling electric power from the battery supply to the auxiliary valve control circuit, whereby the apparatus can prolong the service life of the battery and does not require the user to hold the start button for a certain period of time in order to ignite the burner.

1 Claim, 1 Drawing Sheet

APPARATUS FOR CONTROLLING GAS SUPPLY

BACKGROUND OF THE INVENTION

1. Field of the Invention

This invention is related to an apparatus for controlling gas supply and in particular to one for controlling gas supply to a main burner and an auxiliary burner.

2. Description of the Invention

It has been found that the conventional gas burner is ignited by depressing and holding a button until the thermocouple in the gas burner generates a steady current to the control board. However, the operation for igniting the gas burner requires the user to hold the button for a certain period of time thereby causing much inconvenience in use. Hence, it is proposed to use a battery to ignite the gas burner in order to eliminate this drawback, but the service life of the battery is limited and will not be able to ignite the gas burner in case the battery is flat.

Therefore, it is an object of the present invention to provide an apparatus for controlling gas supply to gas burners which can obviate and mitigate the above-mentioned drawbacks.

SUMMARY OF THE INVENTION

This invention is related to an apparatus controlling gas supply to a main and an auxiliary burners.

It is the primary object of the present invention to provide an apparatus for controlling gas supply to a main and an auxiliary burners which will be powered by a thermopile instead of the battery supply when the main burner is ignited.

It is another object of the present invention to provide an apparatus for controlling gas supply to a main and an auxiliary burners which is simple in construction.

It is still another object of the present invention to provide an apparatus for controlling gas supply to a main and an auxiliary burners which is fit for practical use.

It is still another object of the present invention to provide an apparatus for controlling gas supply to a main and an auxiliary burners which is cheap to manufacture.

It is a further object of the present invention to provide an apparatus for controlling gas supply to a main and an auxiliary burners which is easy to operate.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
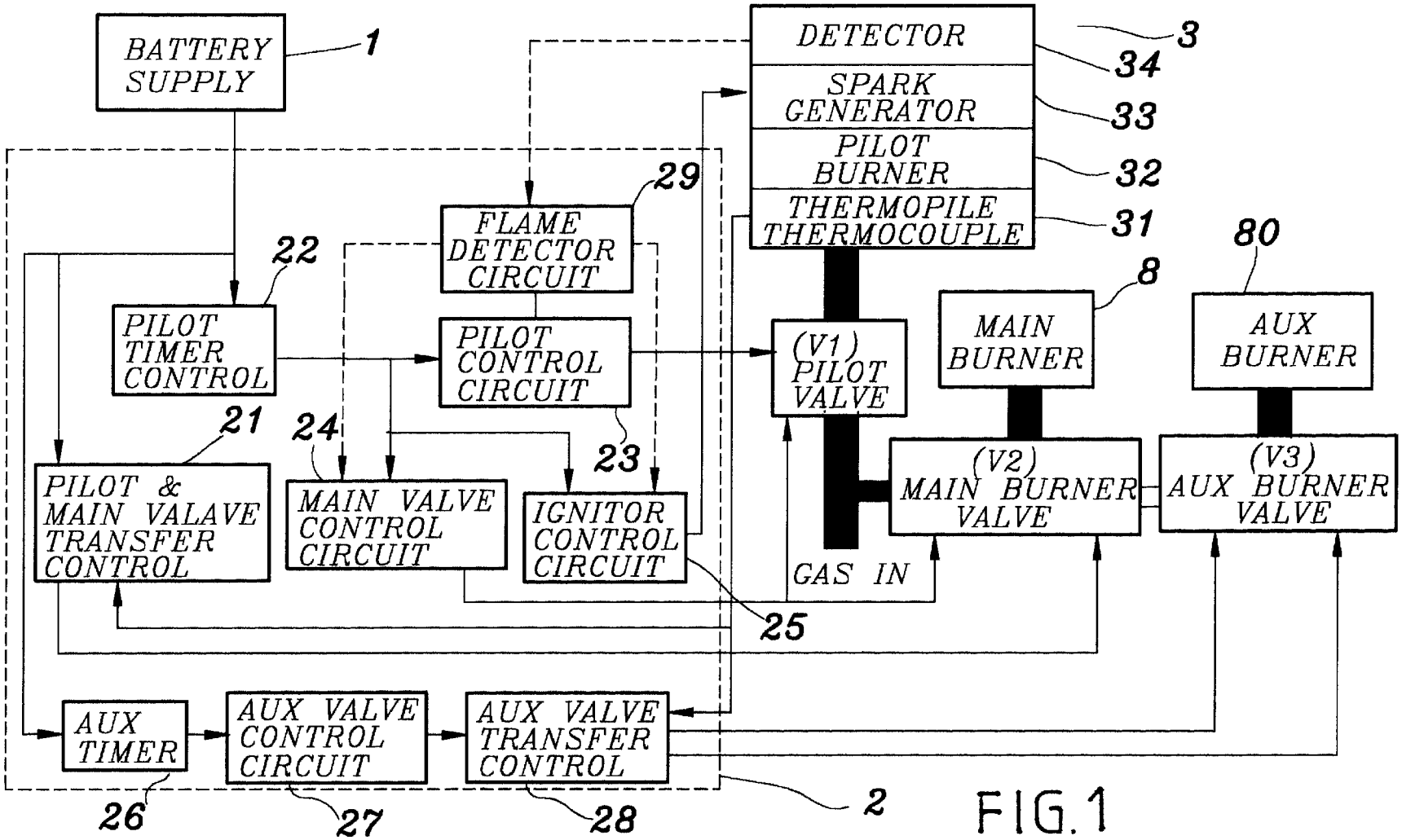
FIG. 1 is a block diagram of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to FIG. 1, the apparatus for controlling gas supply according to the present invention generally comprises a battery supply 1, a control board 2, a pilot seat 3, a pilot valve V1, a main burner valve V2 and an auxiliary burner valve V3. The pilot valve V1 and the main burner valve V2 are normally closed, while the auxiliary burner valve V3 is normally open.

The battery supply 1 includes a case in which are fitted dry batteries for supplying direct current power to the control board 2.

The control board 2 includes a pilot and main valve transfer control 21, a pilot timer control 22, a pilot control circuit 23, a main valve control circuit 24, a ignitor control circuit 25, an auxiliary timer 26, an auxiliary valve control circiut 27, an auxiliary valve transfer control 28 and a flame detector circuit 29.

The pilot seat 3 is provided with a thermopile 31, a pilot burner 32, a spark generator 33 and a detector 34 which are closedly mounted thereon. The thermopile 31 may be replaced with a thermocouple (not shown) as required and designed for supplying power to the pilot and main valve transfer control 21 and the auxiliary transfer control 28. The spark generator 33 is connected and controlled by the ignitor control circuit 25. The detector 34 is a sensor for detecting the burning condition of the pilot burner 32 and sending the information to the flame detector circuit 29.

The pilot timer control 22 is preset so that it will let the electric current from the battery supply 1 flow therethrough for a time period of 20–30 seconds when switched on. The pilot timer control 22 is connected to the pilot control circuit 23 for controlling the electric current supplied to the pilot valve V1 from the battery supply 1. The pilot valve V1 has an inlet connected to a gas supply and an outlet to the pilot burner 32 and is controlled by the pilot control circuit 23 so that when the pilot timer control 22 is switched on, the pilot valve V1 will be turned open letting the gas pass therethrough to the pilot burner 32. In the meantime, the pilot timer control 22 will drive the ignitor control circuit 25 to trigger the spark generator 33 to ignite the pilot burner 32. The detector 34 is a sensor mounted close to the pilot burner 32 for detecting the burning condition of the pilot burner 32. If the pilot fire of the pilot burner 32 is steady, the detector 34 will send out a signal to the flame detector circuit 29 which will in turn make the ignitor control circuit 25 to cease producing sparks via the spark generator 33 and at the same time trigger the main valve control circuit 24 to open the main burner valve V2 to let the gas pass therethrough to the main burner 8. However, if the pilot fire is not yet steady, the detector 34 will send a signal to the flame detector circuit 29 to make the ignitor control circuit 25 continue to produce sparks through the spark generator 33. As the main burner valve V2 is normally closed, no gas will flow therethrough to the main burner 8 thereby preventing gas leakage and possible accident. The battery supply 1 is also connected with the pilot and main valve transfer control 21 and the auxiliary timer 26. The auxiliary timer 26 is connected to the auxiliary control circuit 27 which is in turn connected to the auxiliary valve transfer control 28. The auxiliary valve transfer control 28 is connected to the thermopile 31 and the auxiliary burner valve V3. As the auxilariy timer 26 is turned on, the electric current from the battery supply 1 will flow through the auxiliary timer 26 to the auxiliary valve control circuit 27 which will cause the auxiliary valve transfer control 28 to open the auxiliary burner valve V3 thereby enabling the gas to flow to the auxiliary burner 80. The auxiliary timer 26 is preset so that it will let the electric current from the battery supply 1 flow therethrough for 1–2 seconds when switched on. The thermopile 31 is mounted on the pilot seat 2 and arranged close to the pilot burner 32. When the main burner 8 burns, the thermopile 31 will generate electric current and supply electric power to the pilot and main valve transfer control 21 and the auxiliary valve transfer control 28 thereby making the pilot and main transfer control 21 to cut off the battery supply 1 to the control board 2 and making the auxiliary valve transfer control 28 to keep the auxiliary burner valve V3 open. As a result, when the main burner 8 burns for a certain predetermined period of time, the battery supply 1 will be cut off from the control board 2 and the power required for the operation of the apparatus will be supplied by the thermopile 31 instead of the battery supply 1.

In conclusion, the apparatus according to the present invention can prolong the service life of the battery and does not require the user to hold the start button for a certain period of time in order to ignite the burner.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An apparatus for controlling gas supply comprising:

a battery supply;

a pilot seat on which are mounted a thermopile, a pilot burner, a spark generator and a detector;

a pilot valve;

a main burner valve;

an auxiliary burner valve; and a control board including:

a pilot timer control for controlling electric power to said control board from said battery supply;

a pilot control circuit controlled by said pilot timer control for controlling electric current supplied to said pilot valve;

a main valve control circuit for controlling said main burner valve;

an ignitor control circuit connected to said main valve control circuit for controlling said spark generator;

a pilot and main valve transfer control connected to said battery supply for switching said battery supply to said thermopile;

an auxiliary valve transfer control for controlling said auxiliary burner valve;

an auxiliary valve control circuit for controlling said auxiliary valve transfer control; and an auxiliary timer connected to said battery supply for controlling electric power from said battery supply to said auxiliary valve control circuit.

* * * * *